United States Patent [19]

Morrison et al.

[11] Patent Number: 4,714,820

[45] Date of Patent: Dec. 22, 1987

[54] ELECTRICALLY HEATED CURLING WRAPPER

[75] Inventors: Herbert M. Morrison, Trumbull, Conn.; Jorge Del Mar, Hobe Sound, Fla.

[73] Assignee: Clairol Incorporated, New York, N.Y.

[21] Appl. No.: 768,264

[22] Filed: Aug. 22, 1985

[51] Int. Cl.[4] ..... H05B 3/54; A45D 2/36; H01C 3/06

[52] U.S. Cl. ..... 219/222; 132/33 R; 132/36.2 R; 219/234; 219/528; 219/539; 219/541; 219/549; 338/203; 338/212; 338/293; 338/295

[58] Field of Search ..... 219/222–226, 219/528, 548, 549, 539, 234, 541, 537; 338/203, 295, 212, 293; 132/33 R, 33 G, 36.2 R

[56] References Cited

U.S. PATENT DOCUMENTS

| | | | |
|---|---|---|---|
| 1,703,005 | 2/1929 | Hewitt | 219/539 X |
| 1,883,828 | 10/1932 | Shelton | 219/549 X |
| 1,990,547 | 2/1935 | Jancke | 219/222 |
| 2,125,402 | 8/1938 | Simas | 219/222 |
| 2,457,616 | 12/1948 | Van Dyke et al. | 338/203 X |
| 2,465,722 | 3/1949 | Hamilton | 219/234 X |
| 2,500,554 | 3/1950 | MacDonald et al. | 219/222 |
| 2,719,907 | 10/1955 | Combs | 219/539 X |
| 2,756,756 | 7/1956 | Schepis | 132/36.2 R |
| 2,777,930 | 1/1957 | Nathanson | 338/203 X |
| 3,100,711 | 8/1963 | Eisler | 219/528 X |
| 3,109,438 | 11/1963 | Work | 132/31 R |
| 3,296,415 | 1/1967 | Eisler | 219/549 X |
| 3,347,248 | 10/1967 | Weitzner | 219/222 X |
| 3,417,229 | 12/1968 | Shomphe et al. | 219/549 X |
| 3,523,542 | 8/1970 | Eisler | 219/222 X |
| 3,878,362 | 4/1975 | Stinger | 219/549 X |

FOREIGN PATENT DOCUMENTS

| | | | |
|---|---|---|---|
| 365601 | 1/1932 | United Kingdom | 219/225 |

*Primary Examiner*—Anthony Bartis
*Attorney, Agent, or Firm*—Gene Warzecha

[57] ABSTRACT

An electrically heatable hair wrapper capable of being cut to any predetermined length from a flat, elongated, flexible base carrying a plurality of parallel resistance heating circuits. The circuits extend along the length of the base in a periodic serpentine pattern with the opposite ends of each pattern being electrically connected to continuous parallel buses extending along the longitudinal edges of the base. The flexible base is provided with indicia for indicating where the base and buses may be cut intermediate each adjacent pair of serpentine patterns so as not to destroy the continuity of the selected resistance heating circuits. A bendable, shape-retaining, cuttable wire along each longitudinal edge of the base outwardly of the parallel buses holds the wrapper in any desired shape. A longitudinally flexible flap integrally formed with at least one longitudinal edge of the base is foldable over the base to retain a hair tress between the base and flap during use of the wrapper.

2 Claims, 9 Drawing Figures

ELECTRICALLY HEATED CURLING WRAPPER

BACKGROUND OF THE INVENTION

1. Field of the Invention

The invention relates to devices for treating human hair in order to straighten it or to form it into desired patterns. More particularly, the invention relates to electrical hair treating appliances having electrical resistance heating wires embedded therein for curling or straightening hair.

2. Description of the Prior Art

Hair wrappers are known in the prior art and are generally used as heated hair curling devices. These wrappers usually comprise thin, rectilinear laminated structures having low voltage electrical resistance wires embedded therein and are provided with an attached flap or fold to cover the hair tress. These devices are flexible enough to be rolled and are often used on wet or moistened hair to vaporize the moisture and set the desired curl.

Hair wrappers, sometimes called roll-up type hair curlers, are differentiated from conventional hair rollers. Both may be used to roll hair using the croquinole method (rolling from the tip of the hair tress toward the scalp). However, using a hair wrapper results in maintaining a uniform separation between the heating elements and all parts of the hair tress while using a roller, whether it is heated internally or from an external source such as a hair retaining clip, results in some portions of the hair tress drying before others. Because hair wrappers more uniformly heat hair, a lower temperature may be employed than with a roller to achieve the same result. Also, if the heat can be generated after the wrapper is rolled on a hair tress then a user need not be concerned with the hair drying while it is being rolled, as with conventional heated hair rollers.

An example of a hair wrapper device is shown in U.S. Pat. No. 1,990,547 which discloses a rectilinear laminated structure with an embedded metallic foil arranged in a single serpentine pattern terminating in tab-type electrical terminals which are accessible even after hair is wound on the device. The device is rectangular for being generally aligned with a hair tress and has a rectangular absorbent flap attached to one longitudinal edge of the structure to be folded over the hair tress. The folded wrapper with the hair tress retained therein may then be rolled in the croquignole style. The disadvantage associated with such a device is that requires two electrical connections to be made once the hair has been curled in the wrapper. This requires some care in assuring that the electrical terminals are properly placed.

Another type of prior art device is shown in U.S. Pat. No. 1,883,828. This device also utilizes a rectangular laminate having a single serpentine flat metal or wire pattern embedded therein. However, this device also has two electrical terminals at the ends of the wire and although the terminals may be bent to extend from the end of the roller, some care must be taken to place the terminals conveniently away from the scalp to minimize discomfort.

It is also known to provide a shape-memory curl forming wrapper having a base and two flaps as shown in U.S. Pat. No. 3,109,438. Such device does not however include internal heat generating means.

Another type of electrically heated curling device is shown in U.S. Pat. No. 3,347,248 which discloses a hair curler assembly having electrical resistance wire embedded in either the roller and/or the clip intended to retain the hair on the roller. The device disclosed in this patent also shows simple plug/socket construction to interconnect all of the rollers in series to electrically heat them all simultaneously. This device is, however, a roller rather than a wrapper and cannot, therefore, operate with the same characteristics as the latter.

All of the known prior art hair wrappers utilizing embedded electrical resistance wire elements require that each hair wrapper be made individually with discrete lengths of resistance foil or wire. This limitation adds an unnecessary and, therefore, costly complication to the manufacture of such devices and it is accordingly an object of this invention to provide a hair appliance which overcomes this disadvantage.

Additionally, all of the known prior art hair wrappers which utilize electrical resistance heating require cumbersome connection techniques for connecting the resistance wire terminals to a source of electrical power. Consequently, it is yet another object of this invention to provide a hair curling wrapper which facilitates the connection of the wrapper to a source of electrical power.

It is yet another object of this invention to provide a hair curling wrapper which can be used either for straightening hair or curling it in a variety of patterns.

SUMMARY OF THE INVENTION

These and other objects of the invention are provided by the preferred embodiment disclosed herein which comprises a hair appliance which may cut to any predetermined length and comprises a planar elongated substrata; an electrically conductive resistance-heating printed circuit pattern secured to the base, the pattern being repetitive along the length of the base; a plurality of indicia periodically situated along the length of the base for indicating where it may be transversely cut to produce a hair curling wrapper of a desired length; means for connecting the printed circuit to a source of electrical power to electrically heat the appliance.

The preferred embodiment also includes an interface applicator for connecting the appliance to a source of electrical power after it has been operatively placed in the user's hair, the applicator comprising a base portion for receiving the distal end of the appliance; a top portion for being abutted against the received distal end; means for retaining the top and base portions together thereby retaining the received distal end therebetween; a pair of electrical terminal means within one of the applicator portions for engaging opposite sides of the circuit; an electrical jack connected to the pair of electrical terminals; means for connecting the jack to a source of electrical power.

DESCRIPTION OF THE PREFERRED EMBODIMENT

Figure 1:
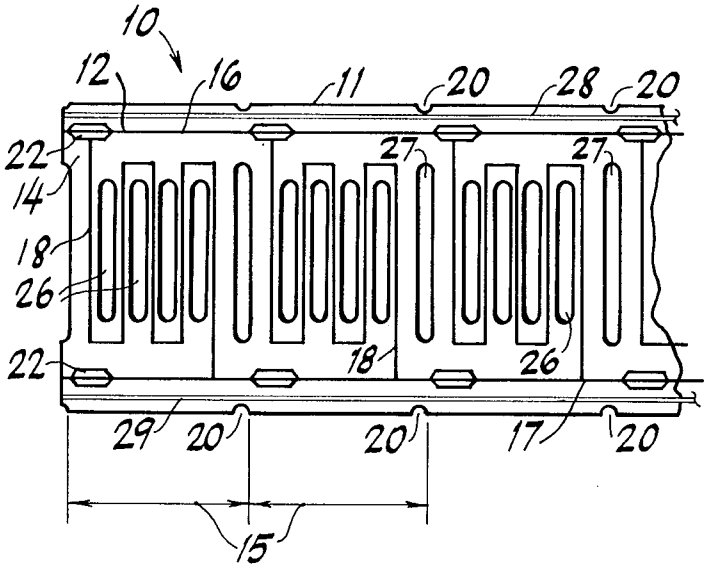
FIG. 1 shows a diagrammatic plan view of a hair curling wrapper constructed in accordance with the principles of this invention.

Referring now to FIG. 1, it will be noted that hair curling wrapper 10 is made in the form of a longitudinal strip 11 having a predetermined width and may be made in an desired length. Wrapper 10 includes a metallic foil 12 in the nature of a printed circuit deposited within a flexible laminated base 14 in a predetermined pattern which is repetitive at periodic intervals 15. The printed circuit pattern is formed of longitudinally extending conducting lines or legs 16 and 17 with serpentine sections 18 connected therebetween to complete a plurality of circuits. It will be understood that longitudinal strip 11 thus comprises a succession of parallel circuits.

Base 14 has periodic notches 20 formed in the opposite parallel sides to serve as indicia indicating the periodicity of the printed circuit and indicating where the longitudinal strip 11 may be cut without destroying the continuity of the selected printed circuits. It will be noted that enlarged printed circuit pads 22 are provided at predetermined positions relative to each notch 20 so that when an end of wrapper 10 is placed in the interface applicator described below, the printed circuits may be easily placed in electrical contact with the electrical terminals of the applicator.

Wrapper 10 is also provided with vent slots 26, for venting steam generated within the interior of the device and for enhancing air circulation, and key slots 27 for facilitating use of the wrapper as will be understood below.

Figure 3:
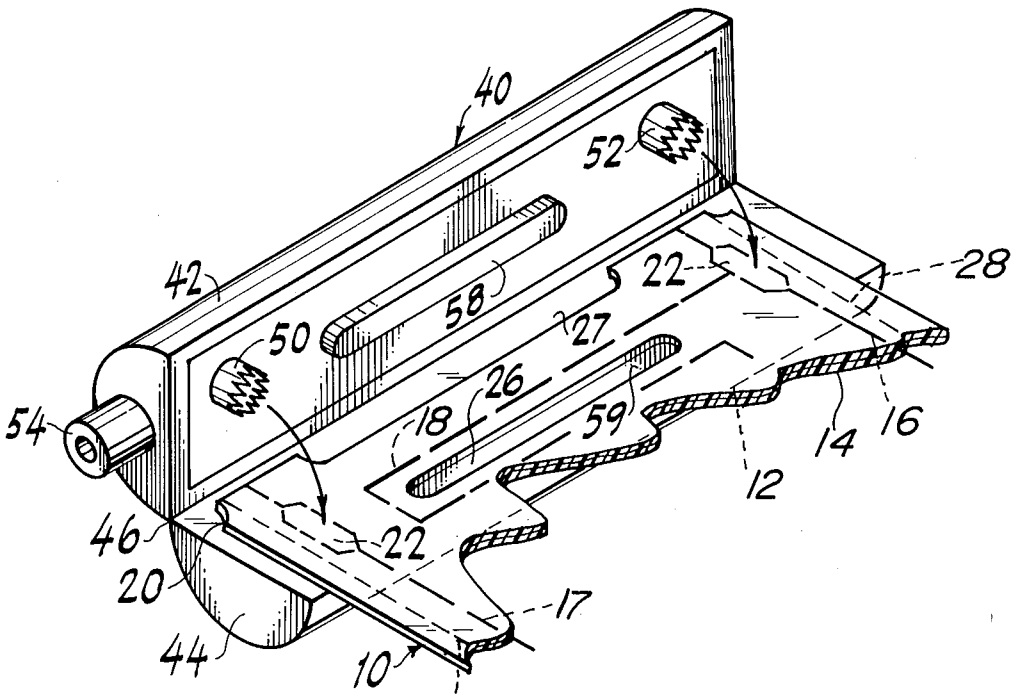
FIG. 3 shows a diagrammatic view of an open interface applicator of the invention in relation to the end of the hair wrapper.
Figure 2:
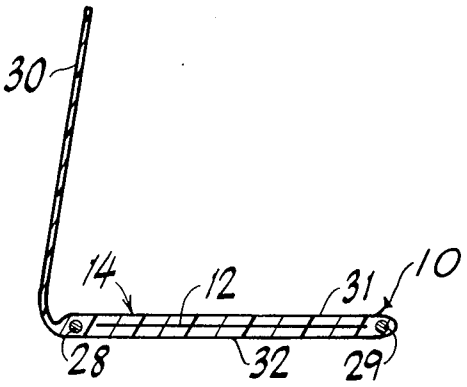
FIG. 2 shows a diagrammatic cross-sectional end view of FIG. 1 with a flap attached to one longitudinal edge.
Figure 4:
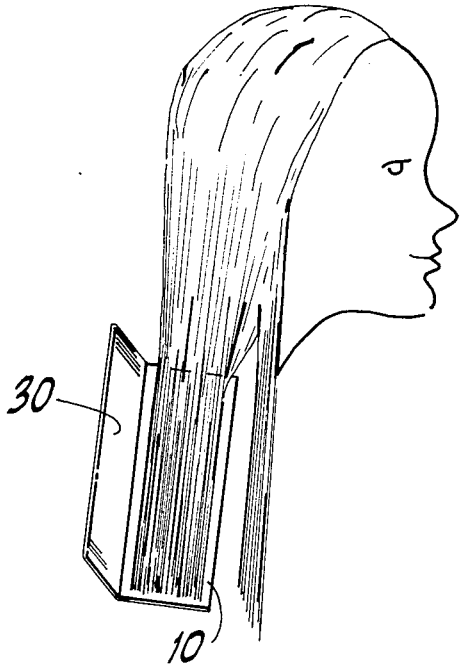
FIGS. 4, 5, and 6 show sequential diagrammatic views of the steps involved in using the invention in a normal manner.

Wrapper 10 is also provided with a pair of parallel shape-retaining wires 28 and 29 transversely outwardly of printed circuit legs 16 and 17 in order to hold wrapper 10 in any desired shape. Wires 28 and 29 are sufficiently small to enable them to be cut. Wrapper 10 may also be provided with a flap extension 30 which, as is best shown in FIGS. 2, 3 and 4 is used to retain a hair tress adjacent laminated base 14. As is best seen in FIG. 2, base 14 includes surfaces 31 and 32 between or on which the printed circuit is deposited and wires are embedded. Surfaces 31 and 32 should preferably be made of flexible electrically insulating material and may be themselves laminated with a desired soft exterior surface. Surface 31 may be relatively thin to conduct heat to the hair while surface 32 may be a thermal insulator so hair is not heated from both sides. Flap 30 may be made from absorbent or non-absorbent material. It should be apparent that these various materials should be able to be easily cut.

Referring now to FIG. 3, there is shown a diagrammatic view of an open cylindrical interface applicator 40 and one end of a hair wrapper 10. The cylindrical profile facilitates rolling the hair, as will be understood below. Applicator 40 comprises a top portion 42 and a base portion 44, each of which may be constructed of a suitable rigid plastic and which may be joined along their common edge 46 by a conventional longitudinal hinge construction. Top portion 42 is provided with insulation piercing electrical terminals 50 and 52 each operatively connected to a jack 54 secured in one end of applicator 40. Top portion 40 also includes a locking key 58 intended to lock into a corresponding slot 59 in base portion 44. Key 58 also extends through slot 26 in order to assist in positioning and retaining the wrapper within the closed applicator. It will be understood that when applicator 40 is closed, both top and base portions will abut along their common interface and electrical terminals 50 and 52 will pierce the insulated surface 31 sufficiently to come into electrical contact with associated printed circuit pads 22 on legs 16 and 17.

Figure 5:
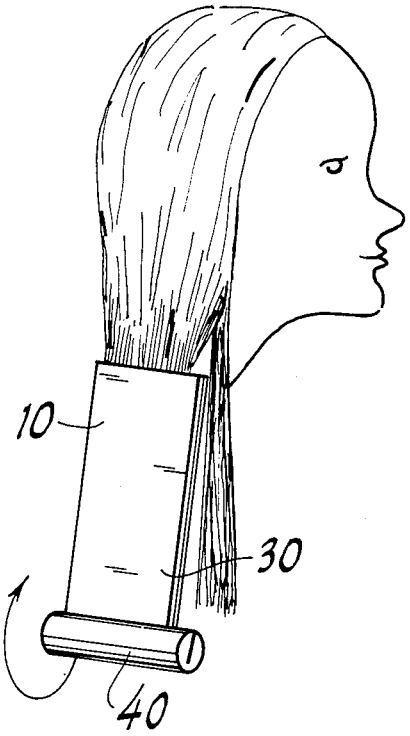
Figure 6:
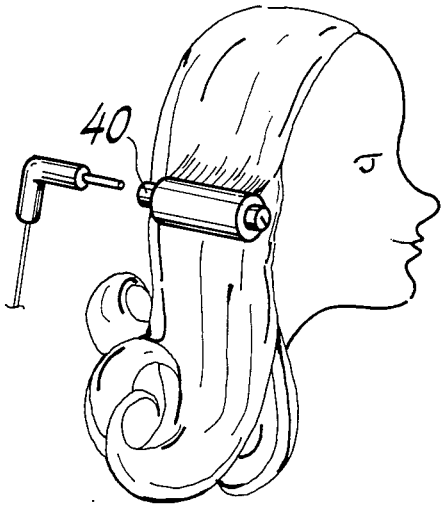

In use, uniform lengths of longitudinal strips 11 may be manufactured and a user may cut each hair wrapper 10 in a variety of lengths chosen by the user according to her preferences and hair length. By reference to FIGS. 4, 5 and 6, one manner of using hair wrapper 10 will be understood. The hair is first placed on the heat generating side of wrapper 10 (FIG. 4), flap 30 is closed and applicator 40 is closed on the end of wrapper 10 (FIG. 5) and the hair is rolled up and held in this position (by, for example, a clip—not shown), and a low voltage D.C. plug connected to an external source of power is plugged in jack 54 (FIG. 6). Alternatively, wrapper 10 may be held closed flat as shown in FIG. 5 by bobby pins, for example (not shown), in order to straighten the hair. The shape retaining wires 28 and 29 facilitate maintaining wrapper 10 in a position in which it is placed, even rolled up as shown in FIG. 6 so external clips may not be necessary in all cases.

Figure 7:
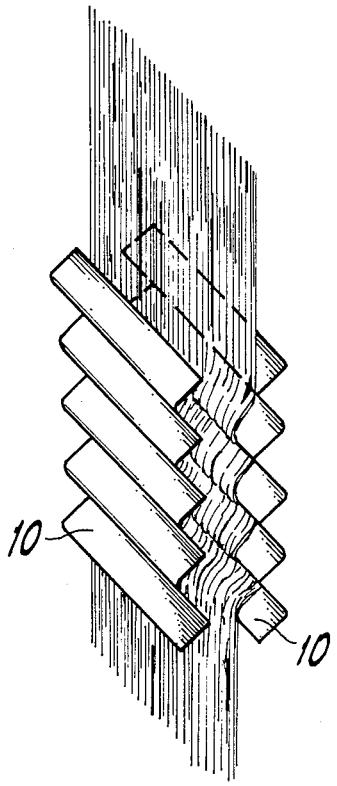
FIGS. 7 and 8 show alternative shapes into which the preferred embodiment may be formed to create alternative curl designs in hair.
Figure 8:
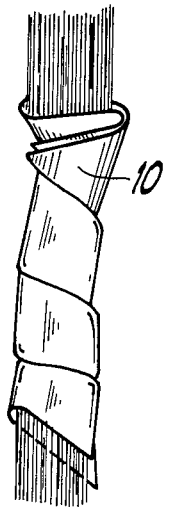

As diagrammatically shown in FIGS. 7 and 8 one or more wrappers 10 may be corrugated to create a pleated hair pattern or twisted to create a spiral effect.

Figure 9:
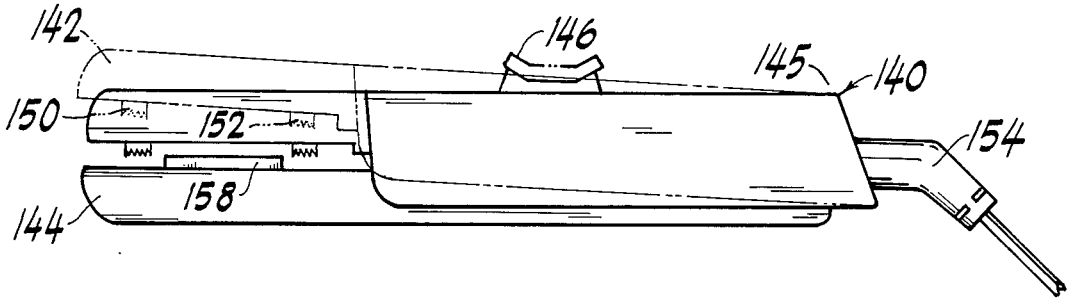
FIG. 9 shows a diagrammatic side elevation view of an alternate interface applicator.

FIG. 9 shows an alternative interface applicator 140 having a top portion 142 and a bottom portion 144 hinged at one end 145. Locking button 146 serves to selectively lock top and bottom portions together as desired. Top portion 142 is shown in both the open (phantom) and closed (solid) positions. The top portion 142 includes insulation piercing electrical contacts 150 and 152 and the bottom portion includes a key element 158. Contacts 150 and 152 are connected to a swivel power cord connection 154. Applicator 140 operates in a manner similar to applicator 40, the primary difference being the way in which the top and bottom portions are hinged and in the use of the swivel connection.

It will be understood by those skilled in the art that numerous other improvements and modifications may be made to the preferred embodiments of the invention disclosed herein without departing from the spirit and scope thereof.

What is claimed is:

1. An electrically heateable hair wrapper comprising:

a flat, elongated base;

a plurality of parallel resistance heating circuits longitudinally extending along and secured to said base, said parallel resistance heating circuits being arranged in periodic serpentine patterns, the two ends of each pattern transversely of the length of said base respectively connected to parallel continuous buses adjacent the longitudinal edges of said base, said buses periodically provided along their length with areas for receiving connecting means to connect at least one of said circuits to a source of electrical power;

at least one indicator means on said base for indicating where said base and buses may be transversely cut while preserving the continuity of a selected one or ones of said parallel resistance heating circuits; and a bendable shape-retaining cuttable wire secured to each longitudinal edge of said base outwardly of said parallel conducting buses.

2. An electrically heatable hair wrapper comprising:

a flat, elongated base;

a plurality of parallel resistance heating circuits longitudinally extending along and secured to said base, said parallel resistance heating circuits being arranged in periodic serpentine patterns, the two ends of each pattern transversely of the length of said base respectively connected to parallel continuous buses adjacent the longitudinal edges of said base, said buses periodically provided along their length with areas for receiving connecting means to connect at least one of said circuits to a source of electrical power;

at least one indicator means on said base for indicating where said base and buses may be transversely cut while preserving the continuity of a selected one or ones of said parallel resistance heating circuits; and a longitudinally extending flexible flap formed integrally with at least one longitudinal edge of said base substantially coextensive therewith, said flap being foldable over said base to retain a hair tress between said base and said flap.

* * * * *